US010738962B1

(12) United States Patent
Shih

(10) Patent No.: US 10,738,962 B1
(45) Date of Patent: Aug. 11, 2020

(54) MULTI-SEGMENT VEHICLE TURNING LIGHT LAMP

(71) Applicant: T.Y.C. BROTHER INDUSTRIAL CO., LTD., Tainan (TW)

(72) Inventor: Ming-Chih Shih, Tainan (TW)

(73) Assignee: T.Y.C. BROTHER INDUSTRIAL CO., LTD., Tainan (TW)

( * ) Notice: Subject to any disclaimer, the term of this patent is extended or adjusted under 35 U.S.C. 154(b) by 0 days.

(21) Appl. No.: 16/562,920

(22) Filed: Sep. 6, 2019

(51) Int. Cl.

| | |
|---|---|
| ***F21S 43/31*** | (2018.01) |
| ***F21S 43/20*** | (2018.01) |
| ***F21S 43/40*** | (2018.01) |
| ***F21S 43/14*** | (2018.01) |
| *F21Y 115/10* | (2016.01) |
| *F21W 103/20* | (2018.01) |

(52) U.S. Cl.
CPC ..... *F21S 43/31* (2018.01); *F21S 43/14* (2018.01); *F21S 43/26* (2018.01); *F21S 43/40* (2018.01); *F21W 2103/20* (2018.01); *F21Y 2115/10* (2016.08)

(58) Field of Classification Search
CPC ..... F21S 43/40; F21S 43/14; F21S 43/26
See application file for complete search history.

(56) References Cited

U.S. PATENT DOCUMENTS

| | | | | |
|---|---|---|---|---|
| 2016/0084467 | A1* | 3/2016 | Kaneko | F21S 43/241 362/511 |
| 2017/0327033 | A1* | 11/2017 | Muegge | F21V 5/003 |
| 2017/0355321 | A1* | 12/2017 | Dellock | B60R 13/02 |
| 2019/0264887 | A1* | 8/2019 | Albou | G02F 1/133603 |

* cited by examiner

*Primary Examiner* — Evan P Dzierzynski
(74) *Attorney, Agent, or Firm* — Burris Law, PLLC

(57) ABSTRACT

A multi-segment turning light lamp includes a lamp housing assembly and a lighting assembly. The lamp housing assembly includes a substrate, a lens having a concave inner surface, and a light divider arrangement disposed between the substrate and the lens. The light divider arrangement includes a plurality of partitions angularly arranged with respect to a center of curvature of the concave inner surface of the lens, and extending radially to the lens. The partitions, the substrate and the lens cooperate to define a plurality of light-exit channels. The lighting assembly includes a plurality of light-emitting elements, each of which is disposed for emitting light through a respective one of the light-exit channels.

9 Claims, 6 Drawing Sheets

MULTI-SEGMENT VEHICLE TURNING LIGHT LAMP

FIELD

The disclosure relates to a light lamp for a vehicle, more particularly to a multi-segment vehicle turning light lamp which is configured for multi-segmented illumination and can be used in vehicles with three or more wheels.

BACKGROUND

Referring to FIG. 1, a conventional turning light lamp is mounted on the outer side of a headlight 11 which acts as a main illumination source of a vehicle and which has an optical axis extending in a front-rear direction. The conventional turning light lamp includes a curved reflector 12, and a halogen bulb 13 disposed with respect to the reflector 12. Such a turning light lamp can provide illumination in addition to the illumination provided by the headlight 11 while the vehicle is turning, such that the vehicle turning safety can be enhanced. However, the above-mentioned turning light lamp is bulky and provides only single-segment lighting.

SUMMARY

Therefore, the object of the disclosure is to provide a multi-segment vehicle turning light lamp to overcome at least one disadvantage of the prior art.

According to the disclosure, the multi-segment vehicle turning light lamp includes a lamp housing assembly and a lighting assembly.

The lamp housing assembly includes a substrate having a plane surface, a lens disposed in front of the substrate and having a concave inner surface that faces the substrate, and a light divider arrangement disposed between the substrate and the lens. The light divider arrangement includes a plurality of partitions that are angularly arranged with respect to a center of curvature of the concave inner surface of the lens and that extend radially to the lens. The plurality of partitions, the substrate and the lens cooperate to define a plurality of light-exit channels. The lighting assembly includes a plurality of light-emitting elements disposed on the plane surface of the substrate. Each of the light-emitting elements is disposed for emitting light through a respective one of the light-exit channels.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
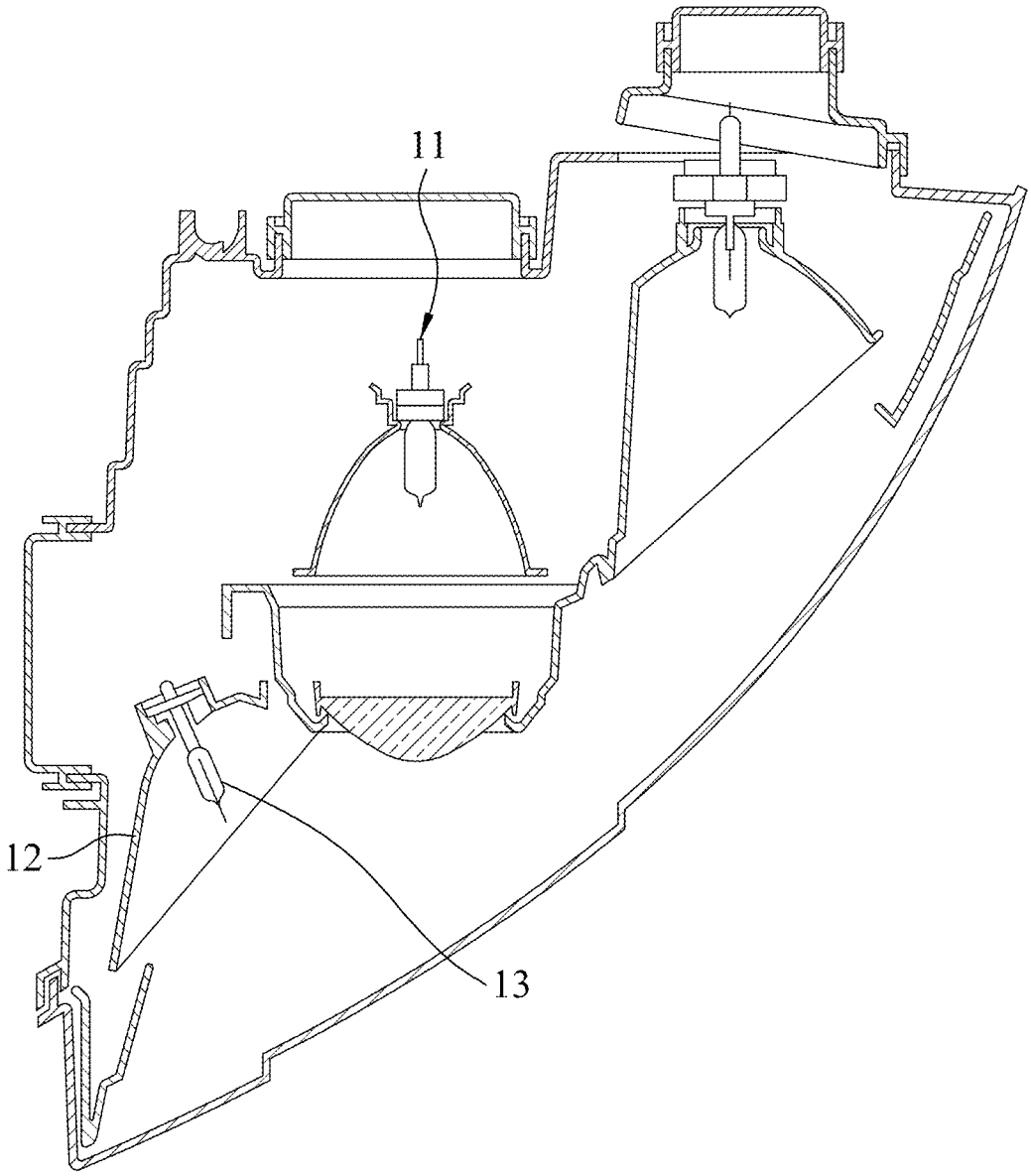
FIG.1 PRIOR ART
FIG. 1 is a cross-sectional view of a conventional turning light lamp.
Figure 2:
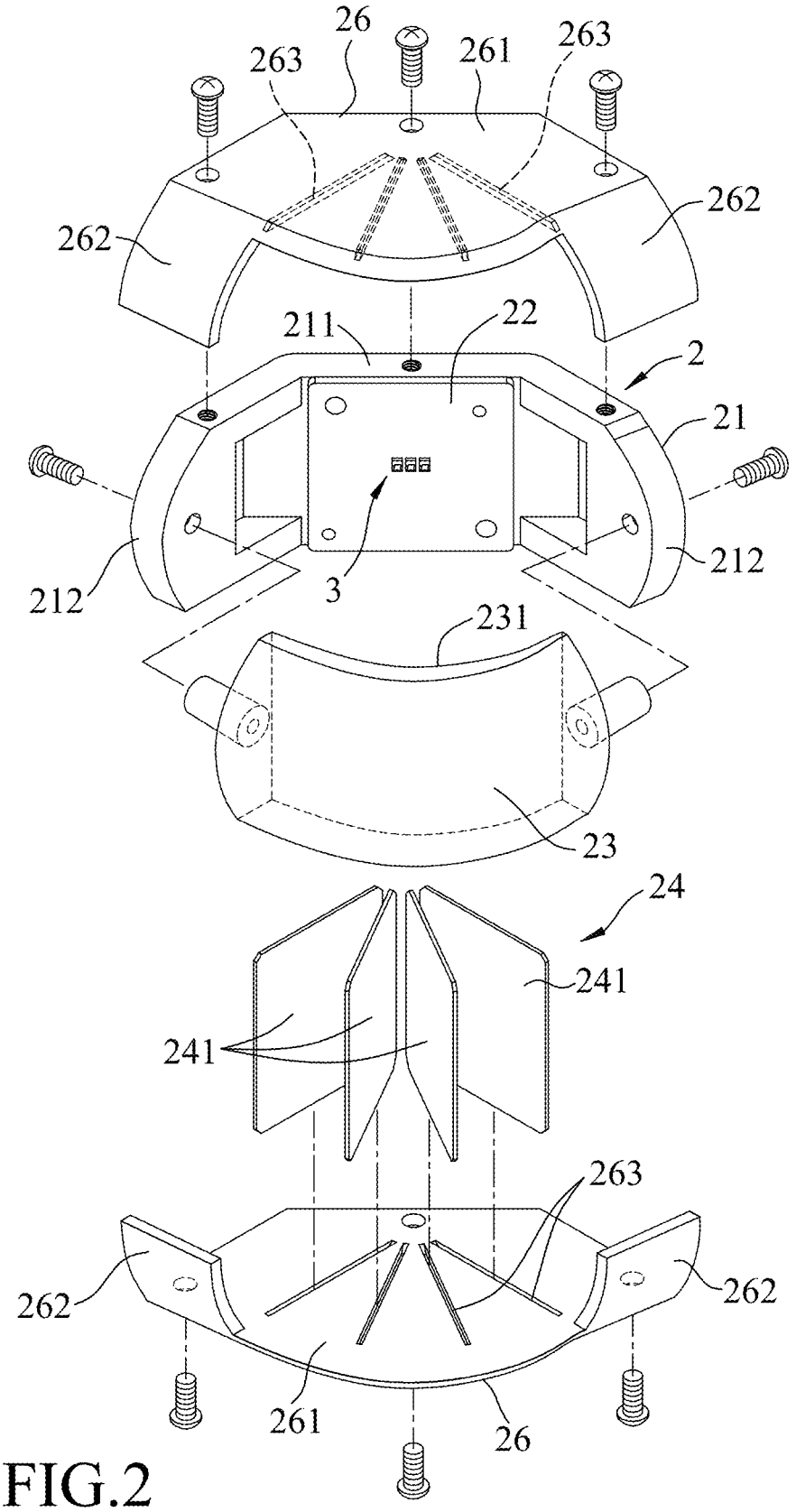
FIG. 2 is an exploded perspective view of an embodiment of a multi-segment vehicle turning light lamp according to the present disclosure.
Figure 3:
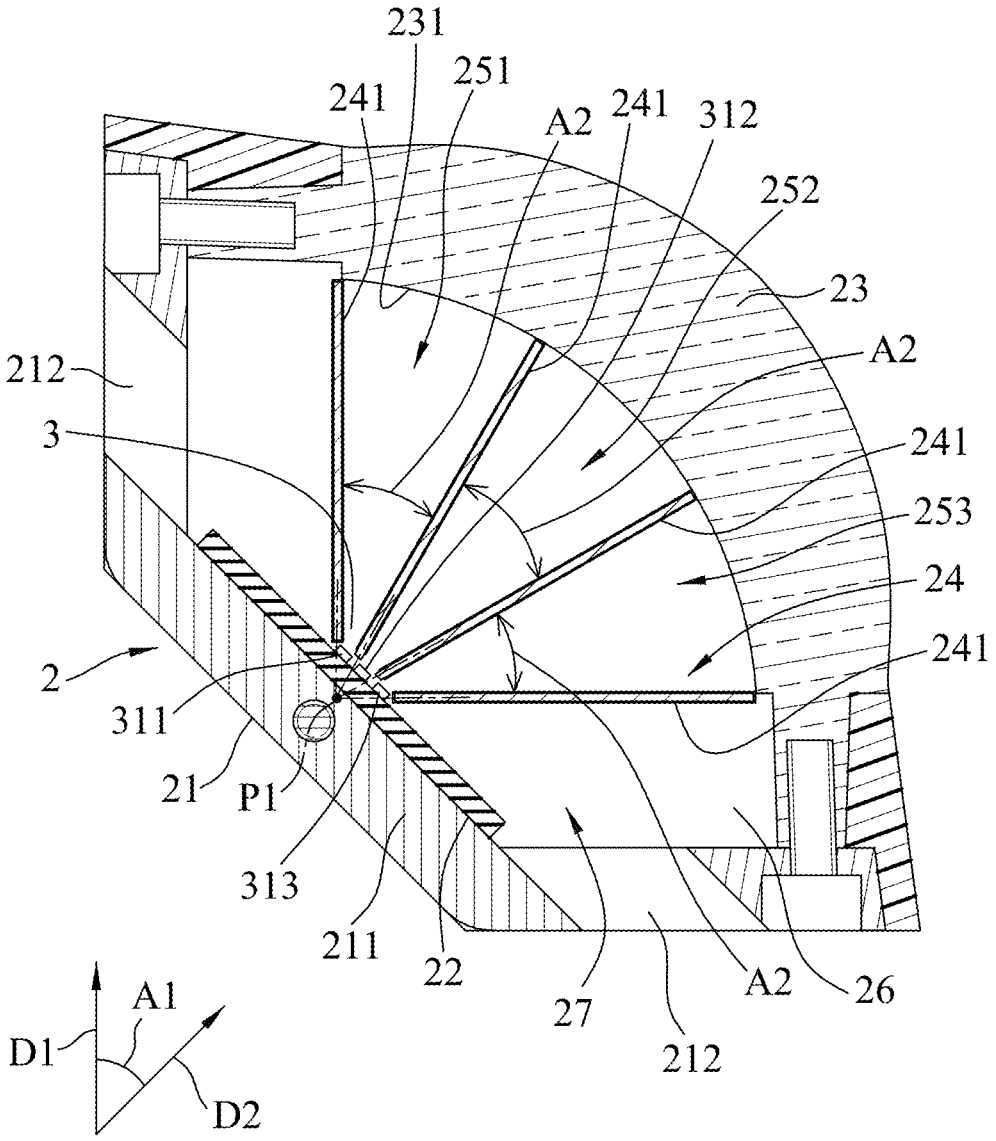
FIG. 3 is an assembled cross-sectional view illustrating the embodiment.
Figure 4:
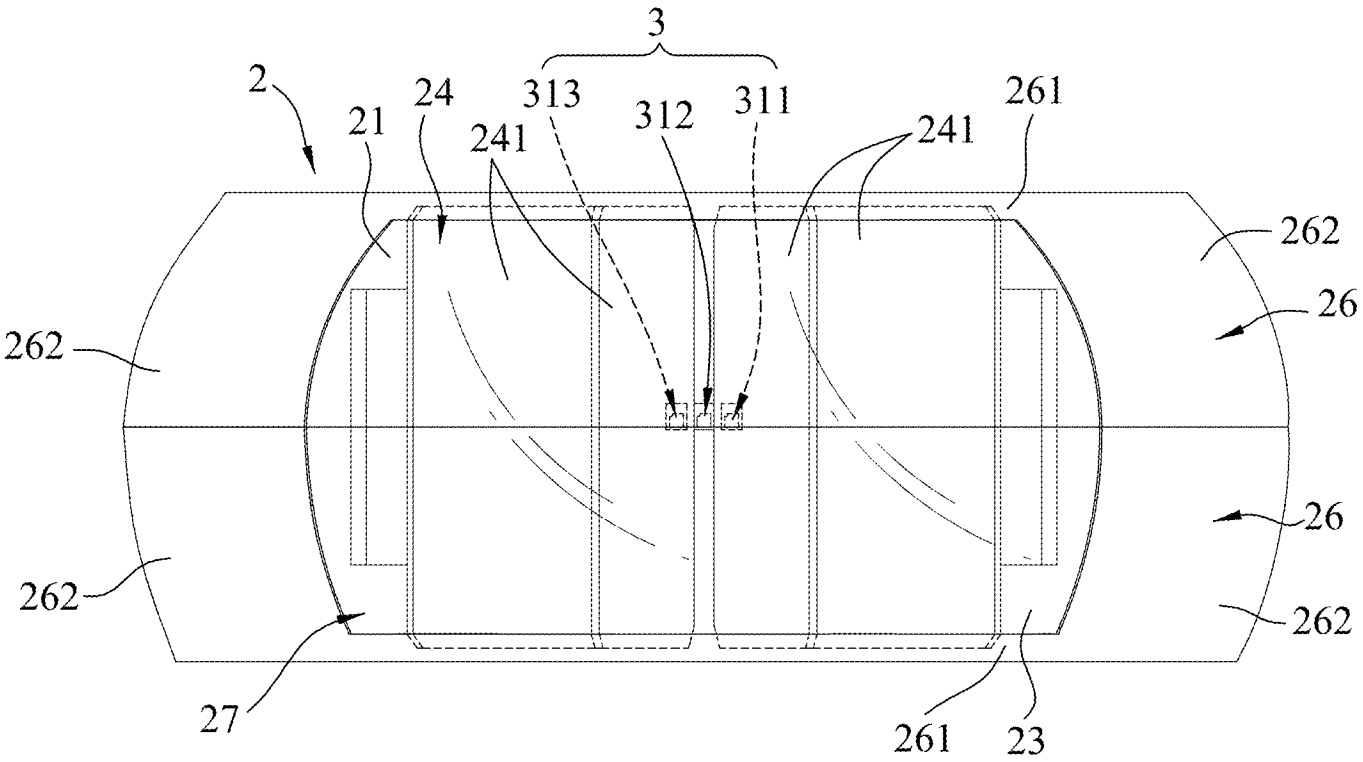
FIG. 4 is a front view of the embodiment, the angle of vision is toward a lens of the embodiment.

As shown in FIGS. 2 to 4, an embodiment of the multi-segment turning light lamp according to the present disclosure can be mounted by the side of a headlight (not shown) of a vehicle. The headlight emits light along an optical axis extending in a front-rear direction (D1).

The multi-segment turning light lamp includes a lamp housing assembly 2 and a lighting assembly 3.

The lamp housing assembly 2 includes a substantially U-shaped lamp holder 21, a substrate 22 fixed on the lamp holder 21, a lens 23 disposed in front of and spaced from the substrate 22, a light divider arrangement 24 provided between the substrate 22 and the lens 23, and upper and lower lamp shells 26 disposed respectively on upper and lower sides of the substrate 22, the lens 23 and the light divider arrangement 24. The substrate 22 has a plane surface. A direction (D2) normal to the plane surface of the substrate 22 is inclined to the front-rear direction (D1).

The lamp holder 21 includes a base portion 211 which is perpendicular to the direction (D2) which is normal to the plane surface of the substrate 22, and a pair of side wing portions 212 extending respectively from opposite ends of the base portion 211.

An angle (A1) included between the direction (D2) and the front-rear direction (D1) is 45 degrees. The substrate 22 is of a rectangular shape and is fixed on the base portion 211 of the lamp holder 21.

Referring to FIGS. 2 and 3, the lens 23 is disposed in front of the light divider arrangement 24, and includes a concave inner surface 231 facing the plane surface of the substrate 22. The arc length in a cross-section of the concave inner surface 231 is a quarter of circle, and the center of curvature of the concave inner surface 231 is designated as a reference point (P1).

The light divider arrangement 24 includes a plurality of partitions 241 that are angularly arranged with respect to the reference point (P1) and that extend radially to the lens 23. Each partition 241 is a reflector of substantial rectangular shape for reflecting light. The partitions 241, the substrate 22 and the lens 23 cooperate to define a plurality of substantially fan-shaped light-exit channels behind the lens 23 (i.e., the lens 23 is disposed in front of the light-exit channels). In this embodiment, the light-exit channels as seen in FIG. 3 has, from left to right, a first light-exit channel 251, a second light-exit channel 252, and a third light-exit channel 253. Each of the first, second, and third light-exit channels 251, 252, 253 has the same central angle (A2). The central angle (A2) of each of the first, second and third light-exit channels 251, 252, 253 is substantially 30 degrees.

The upper and lower lamp shells 26 cooperate with the lamp holder 21 to define a housing space 27 into which the substrate 22, the light-divider arrangement 24 and the lighting assembly 3 are received. Each of the upper and lower lamp shells 26 has a substantially fan-shaped base 261 and a pair of tabs 262. The bases 261 of the upper and lower lamp shells 26 cover respectively upper and lower sides of the housing space 27 (i.e., cover respectively upper and lower sides of the substrate 22, the lens 23 and the light divider arrangement 24). The base 261 of the upper lamp shell 26 is formed with a plurality of slots 263 retaining respectively upper end portions of the partitions 241, and the base 261 of the lower lamp shell 26 is formed with a plurality of slots 263 retaining respectively lower end portions of the partitions 241, such that the partitions 241 are held in place. The pair of tabs 262 of each of the upper and lower lamp shells 26 extend respectively from opposite ends of a front edge of the base 261 toward the other one of the upper and lower lamp shells 26. The tabs 262 of the upper and lower lamp shells 26 wrap around front ends of the side wing portions 212 of the lamp holder 21.

The lighting assembly 3 includes a plurality of light-emitting elements, which are horizontally laid on the plane surface of the substrate 22 at intervals. In this embodiment, the light-emitting elements include a first light-emitting element 311, a second light emitting element 312, and a third light-emitting element 313 that are disposed for emitting light through a respective one of the first, second and third light-exit channels 251, 252, 253.

Each of the first, second and third light-emitting elements 311, 312, 313 is a light emitting diode (LED) chip, and is of rectangular shape with four sides extending in a horizontal direction or a vertical direction. Specifically, each of the first, second and third light-emitting elements 311, 312, 313, has two opposite sides extending in the horizontal direction, and another two opposite sides extending in the vertical direction. In this embodiment, each of the first, second and third light-emitting elements 311, 312, 313 is a square LED chip. An optical axis of each of the first, second and third light-emitting elements 311, 312, 313 extends in the direction (D2) which is normal to the plane surface of substrate 22, that is, the light-emitting elements 311, 312, 313 can project light forward in the direction (D2).

Referring to FIGS. 3 and 5 to 7, the multi-segment vehicle turning light lamp according to the disclosure can provide multi-segmented illumination with different illumination ranges depending on the steering angle of the vehicle while turning.

Figure 5:
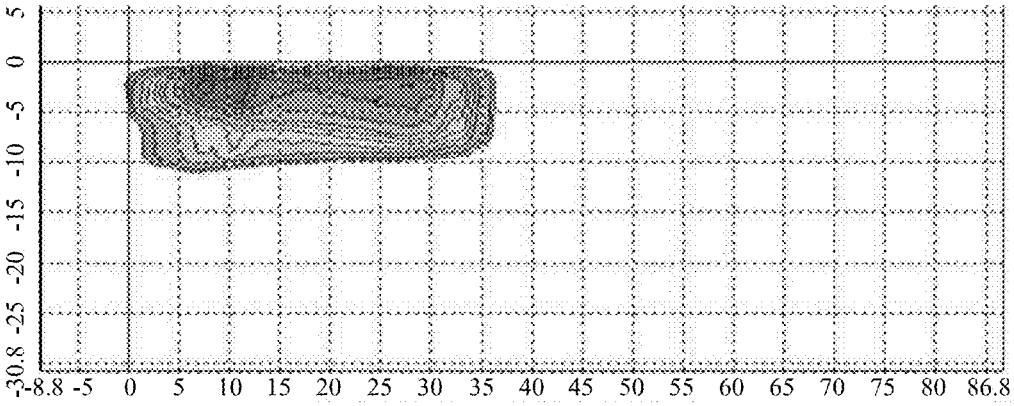
FIG. 5 is a representation of an optical shape while a first light-emitting element of the embodiment projects light.
Figure 6:
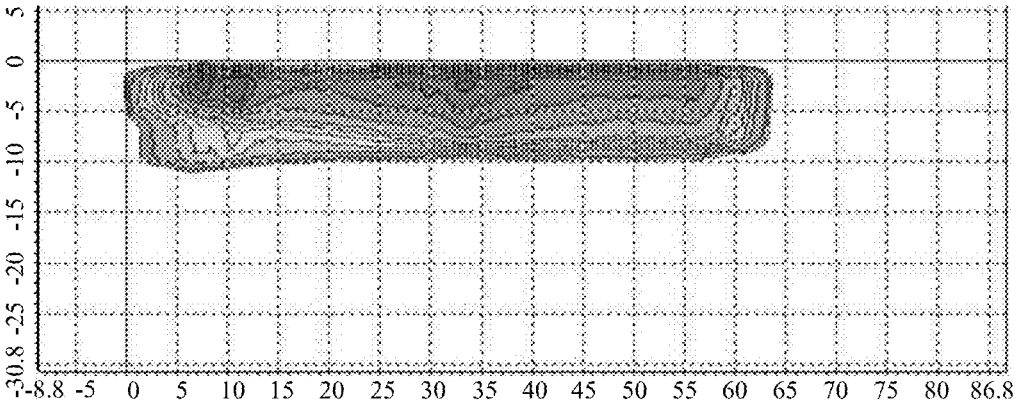
FIG. 6 is a representation of an optical shape while the first light-emitting element and a second light-emitting element project light.

In the event of a small steering angle of the vehicle while turning, the first light emitting element 311 will emit and project light forward in the direction (D2), but the second light emitting element 312 and the third light emitting element 313 do not emit light. At this time, the multi-segment vehicle turning light lamp produces an optical shape as shown in FIG. 5. In the event of a medium steering angle of the vehicle while turning, the first light-emitting element 311 and the second light-emitting element 312 both emit and project light forward in the direction (D2), but the third light-emitting element 313 does not emit light. At this time, the multi-segment vehicle turning light lamp generates an optical shape as shown in FIG. 6. In the event of a large steering angle of the vehicle while turning, the first light-emitting element 311, the second light-emitting element 312 and the third light emitting element 313 will emit light together to generate an optical shape as shown in FIG. 7.

Figure 7:
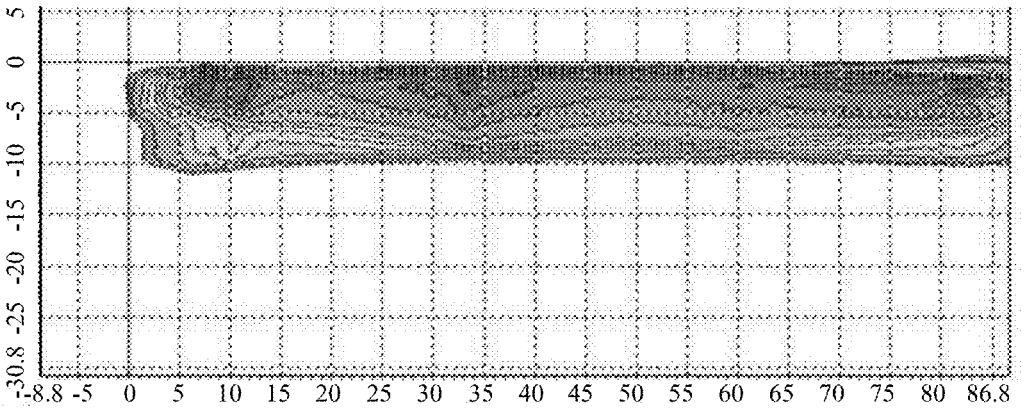
FIG. 7 is a representation of an optical shape while the first and second light-emitting elements and a third light-emitting element project light.

The partitions 241, the substrate 22 and the lens 23 cooperate to define the first light-exit channel 251, the second light-exit channel 252 and the third light-exit channel 253, through this arrangement, the light beams of the first light emitting element 311, the second light emitting element 312 and the third light emitting element 313 can be controlled separately, so as to achieve the multi-segmented illumination as shown in FIGS. 5 to 7. Each of the partitions 241 has a reflection surface for reflecting light emitted from a respective one of the first, second and third light-emitting elements 311, 312, 313, so that the multi-segment turning light possesses better light extraction efficiency compared with the partitions with black light-absorbing surfaces.

In this embodiment, the configuration that the central angle (A2) of each of the first light-exit channel 251, the second light-exit channel 252 and the third light-exit channel 253 is substantially 30 degrees provides a distinct visual effect in the change of optical shape, thus creating a sense of style and technology.

In addition, since the first, second and third light-emitting elements 311, 312, 313 are horizontally spaced with four sides of each of the first, second and third light-emitting members 311, 312, 313 extending in the horizontal direction or the vertical direction, the first, second and third light-emitting elements 311, 312, 313 generate light beams parallel to the road surface and being more adaptive to the lighting of the road surface, thereby further enhance the road safety. The first, second and third light-emitting elements 311, 312, 313 integrated on the substrate 22 are cooperated with the construction of radially disposed partitions 241 to provide a simplified overall design of the multi-segment vehicle turning light lamp.

In summary, the effect of the multi-segment vehicle turning light lamp of the present disclosure resides in that, the first, second and third light-emitting elements 311, 312, 313 are integrated on the substrate 22 and cooperate with the first, second and third light-exit channels 251, 252, 253 defined between the partitions 241 to enable multi-segmented illumination, and the overall design is concise.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular feature, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects, and that one or more features or specific details from one embodiment may be practiced together with one or more features or specific details from another embodiment, where appropriate, in the practice of the disclosure.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A multi-segment turning light lamp for a vehicle, comprising:

a lamp housing assembly including a substrate that has a plane surface, a lens disposed in front of said substrate and having a concave inner surface that faces said substrate, and a light divider arrangement disposed between said substrate and said lens, said light divider arrangement including a plurality of partitions that are angularly arranged with respect to a center of curvature of said concave inner surface of said lens and that extend radially to said lens, said plurality of partitions, said substrate and said lens cooperating to define a plurality of light-exit channels; and a lighting assembly including a plurality of light-emitting elements that are disposed on said plane surface of said substrate, each of said light-emitting elements being disposed for emitting light through a respective one of said light-exit channels.

2. The multi-segment turning light lamp as claimed in claim 1, wherein each of said light-exit channels is of substantial fan-shape, said lamp housing assembly further including upper and lower lamp shells that cover respectively upper and lower sides of said substrate, said lens and said light divider arrangement.

3. The multi-segment turning light lamp as claimed in claim 1, wherein each of said light-exit channels is of substantial fan-shape, said lens being disposed in front of said plurality of light-exit channels.

4. The multi-segment turning light lamp as claimed in claim 1, wherein each of said light-exit channels is of substantial fan-shape, and each of said light-exit channels has the same central angle.

5. The multi-segment turning light lamp as claimed in claim 4, wherein the central angle of each light-exit channel is substantially 30 degrees.

6. The multi-segment turning light lamp as claimed in claim 1, wherein each of said light-emitting elements is of rectangular shape with four sides extending in a horizontal direction or a vertical direction.

7. The multi-segment turning light lamp as claimed in claim 6, wherein each of said light-emitting elements is a light emitting diode chip.

8. The multi-segment turning light lamp as claimed in claim 6, wherein an optical axis of each of said light-emitting elements extends in a direction normal to said plane surface of said substrate.

9. The multi-segment turning light lamp as claimed in claim 1, wherein each of said partitions includes a reflection surface for reflecting light emitted from a respective one of said light-emitting elements.

* * * * *